US006488989B1

(12) United States Patent
McCormick

(10) Patent No.: US 6,488,989 B1
(45) Date of Patent: Dec. 3, 2002

(54) HYDROPHILICIZING SURFACES, ESPECIALLY ALUMINUM

(75) Inventor: David R. McCormick, Clawson, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/485,654

(22) PCT Filed: Aug. 13, 1998

(86) PCT No.: PCT/US98/16449

§ 371 (c)(1),
(2), (4) Date: Apr. 26, 2000

(87) PCT Pub. No.: WO99/08807

PCT Pub. Date: Feb. 25, 1999

Related U.S. Application Data

(60) Provisional application No. 60/055,638, filed on Aug. 14, 1997.

(51) Int. Cl.[7] ..... B05D 3/02; C23C 27/00

(52) U.S. Cl. ..... 427/388.4; 148/251; 148/253; 524/417; 524/430; 524/547

(58) Field of Search ..... 427/388.4, 404; 148/251, 253; 524/417, 430, 547

(56) References Cited

U.S. PATENT DOCUMENTS 4,783,224 A * 11/1988 Sako et al. ..... 148/6.27
5,298,289 A * 3/1994 Lindert et al. ..... 427/388.4

* cited by examiner

*Primary Examiner*—Peter D. Mulcahy
(74) *Attorney, Agent, or Firm*—Stephen D. Harper; Daniel S. Ortiz

(57) ABSTRACT

An especially effective hydrophilicizing treatment for solid surfaces, particularly those of conversion coated aluminum, is a liquid mixture of water, organic polymer molecules that include sulfonyl/ate moieties, and preferably also a substance made by mixing with aqueous phosphoric acid at least one metal, metal oxide, or metal hydroxide so as to form a transparent liquid mixture. The treatment liquid preferably has a nearly neutral pH and is applied to a substrate and dried in place by exposure to heat.

20 Claims, No Drawings

HYDROPHILICIZING SURFACES, ESPECIALLY ALUMINUM

This application is a 371 of PCT/US98/16499 filed Aug. 13, 1998 which claims benefit of Prov. No. 60/055,638 filed Aug. 14, 1997.

BACKGROUND OF THE INVENTION

This invention relates to a hydrophilicizing treatment for a surface, usually a surface with underlying metal already bearing a corrosion protective conversion coating. Previously known corrosion protective coatings that do not require the use of chromium during their formation can be combined with the characteristic hydrophilicizing treatment according to this invention to form a high quality and durable hydrophilic surface. After treatment according to this invention, water will have a tendency to spread spontaneously over the surface. The invention is particularly advantageously applicable to provide aluminum evaporators, heat exchangers, and condensers with hydrophilic coatings that have good corrosion resistance and little or no tendency to develop undesirable odors during use.

Although any of the common structural metals can be used in constructing practical heat exchanging surfaces, aluminum and its alloys are among those most often used, because of their high heat conductivity. In heat exchanger surfaces, metals are normally used without any relatively thick protective coating such as a paint or lacquer that would generally be used in other types of equipment made from metals and exposed to corrosive environments, to improve the resistance of the equipment, but any such relatively thick protective coating is avoided in heat exchangers because such a coating would also reduce the efficiency of heat exchange.

During the cooling of hot air, a common use of these heat exchangers, moisture contained as vapor in the hot air condenses and initially forms water drops or beads on the fins of the heat exchanger. If the surface of the heat exchanger fins is not sufficiently hydrophilic, these water beads accumulate on the fin surface and tend to bridge across the small spaces between fins, thereby impeding the air flow between fins and reducing the heat transfer efficiency. The condensed water beads also tend to absorb dust and contaminants in the air, such as carbon dioxide, nitrogen oxides, and sulfur oxides, which can promote corrosion of the underlying aluminum, and because of the capillary forces holding in place water drops that have grown sufficiently large to bridge between adjacent fins, the normal drainage of water away from the fins that would otherwise carry away these absorbed contaminants is substantially reduced. Therefore, the formation of water beads on the fins of an aluminum heat exchanger not only decreases heat transfer efficiency but also can physically damage the exchanger.

In order to achieve a desirable combination of a hydrophilic nature and corrosion resistance on metal, particularly aluminum, surfaces, various coatings and treatments have been tried, but no fully satisfactory result has yet been achieved. A chromate conversion coating without any post-treatment usually has inadequate corrosion resistance and often develops an unpleasant odor and poor hydrophilicity. Silicate coating over a chromate conversion coat has often been used but has not satisfied all users. More recently, biocide protected hydrophilic organic polymer films have been used as post-treatments over chromate conversion coatings. While effective, these have proved to be expensive and difficult to control in some commercial operations.

Major alterative or concurrent objects of the invention are to achieve (i) a combination of adequate hydrophilicity and corrosion resistance, compared with the prior art, while avoiding the use of polluting constituents, and of highly volatile constituents, particularly organic solvents, with potential toxicity or unpleasant odors for workers, in the treatment compositions, (ii) durability of the hydrophilicity under thermal aging and/or practical use, and (iii) avoidance of the development of unpleasant odors during practical use. Other objects will be apparent from the description below.

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; chemical descriptions of neutral materials apply to the materials at the time of addition to any combination specified in the description and/or of generation in situ in a combination by chemical reactions described in the specification, and do not necessarily preclude chemical changes to the materials as a result of unstated reaction in the combination; specification of materials in ionic form means that the materials are supplied to prepare the compositions containing them in the form of soluble substance(s) containing the ions specified and implies the presence in any composition specified to contain ionic materials of sufficient counterions to produce electrical neutrality for the composition as a whole; any counterions thus implicitly specified preferably are selected from among other constituents explicitly specified in ionic form, to the extent possible; otherwise such counterions may be freely selected, except for avoiding counterions that act adversely to an object of the invention.

BRIEF SUMMARY OF THE INVENTION

It has been found that a hydrophilicity can be imparted to a wide variety of surfaces, and a desirable combination of hydrophilicity and corrosion resistance can be achieved on a surface with underlying metal, particularly aluminum and its alloys containing at least 75% by weight of aluminum, by contacting the surface, preferably, if the surface has underlying metal, after this metal has already been supplied with a corrosion protective coating, with an aqueous liquid composition that comprises, preferably consists essentially of, or more preferably consists of, water and:

(A) a sufficient amount of a component of dissolved and/or stably dispersed[1] polymers containing —$SO_3M$ moieties, where M represents hydrogen, a monovalent cation, or a monovalent fraction of a cation with a valence of two or higher; and, optionally, one or more of the following components:

[1]i.e., showing no phase separation evident to normal unaided human vision within a period of observation of 100, or preferably 1000, hours.

(B) a component of one or more dissolved substances which can be made, and preferably actually is made, by dissolving at least one of elemental metals, metal oxides, and metal hydroxides in aqueous phosphoric acid;

(C) a component of pH adjusting substances that are not part of any one of components (A) and (B) as described above; and (D) an anti-microbial effective amount of at least one anti-microbial agent that is not part of any of components (A) through (C) as described above, the amount of component (A) being sufficient in a process according to the invention if the specific surface being treated has a smaller spreading contact angle of pure liquid water on the surface after being treated with a composition according to the invention than the same surface had before such treatment; for a composition according to the invention, the amount of component (A) is sufficient if at least one type of surface can be treated with the composition in a process according to the invention so that pure liquid water has a smaller spreading contact angle on the surface after treatment than on the surface before treatment.

One embodiment of the invention is a composition as described above suitable for direct use in imparting hydrophilicity to a surface; such a composition may be described hereinafter as a "working composition". Another embodiment of the invention is a concentrate composition, which can be diluted with water to produce a working composition as specified above. A concentrate composition according to this invention preferably comprises from 1.5 to 10, more preferably from 2.5 to 5, or still more preferably from 3.6 to 4.4, times the concentrations of each of the components, except for water, of a working composition.

Still another embodiment of the invention is a process of contacting a surface to be hydrophilicized with a working composition according to the invention as described above. Other embodiments, such as an article of manufacture comprising a surface hydrophilicized according to the invention and an extended process including a simple process according to the invention along with other steps that may be conventional per se, will be apparent from the description below.

DETAILED DESCRIPTION OF THE INVENTION

Component (A) as defined above preferably is selected from the group consisting of (i) polymers of vinyl sulfonic acid and (ii) polymer molecules that have most, or more preferably all, of the —$SO_3M$ moieties directly chemically bonded to an aromatic ring, with the latter more preferred. Any aromatic ring, including those with heteroatoms, is suitable, but for economy and commercial availability, simple phenyl rings are preferred and sulfonated polystyrene is particularly preferred. A sufficient ratio of —$SO_3M$ moieties to carbon atoms in the polymers to give the polymer a solubility in water of at least, with increasing preference in the order given, 0.1, 0.3, 0.5, 0.7, 1.0, 2.0, 3.0, or 4.0% is preferred, and more particularly for polymers containing aromatic rings, the ratio of —$SO_3M$ moieties to aromatic rings is at least, with increasing preference in the order given, 0.25:1.0, 0.40:1.0, 0.55:1.0, 0.65:1.0, 0.75:1.0, 0.85:1.0, 0.90:1.0, 0.95:1.0, or 0.99:1.0.

Independently of other preferences, the weight average molecular weight of the polymers in component (A) preferably is at least, with increasing preference in the order given, 1000, 3000, 5000, 7000, 10,000, 20,000, 30,000, 40,000, 50,000, 60,000, 65,000, or 69,000 and independently preferably is not more than, with increasing preference in the order given, 10,000,000, 5,000,000, 3,000,000, 1,000,000, 800,000, 600,000, 400,000, 300,000, 200,000, 150,000, 120,000, 100,000, 90,000, 85,000, 80,000, 75,000, or 71,000.

Also independently of other preferences, when component (A) is dissolved in water in the course of preparation of an aqueous liquid composition according to this invention, it is preferably added in a form for which "M" in the general formula —$SO_3M$ represents an alkali metal cation, so that the polymer added is neutral rather than strongly acidic, as it would be if "M" in this general formula represented hydrogen instead. For reasons of economy, "M" in this general formula most preferably represents sodium.

Preferred sources of component (B) as described above, a component the presence of which is normally highly preferred in an aqueous treatment composition of the invention, may utilize for their anionic and/or unionized parts any of the phosphoric acids in which phosphorus is in its +5 oxidation state, i.e., metaphosphoric acid ($HPO_3$), orthophosphoric acid ($H_3PO_4$), pyrophosphoric acid ($H_4P_2O_7$), or any of the higher condensed phosphoric acids with the general formula $H_{(n+2)}P_nO_{(3n+1)}$, where n represents a positive integer with a value of at least three, or any anions derived from any of these acids. It is generally believed that all these acids are in equilibrium with one another in aqueous solutions, with orthophosphoric acid being much the most predominant at low concentrations and temperatures and the more condensed acids (including metaphosphoric acid) becoming important only at high concentrations and temperatures, or when their salts are present in the aqueous solutions along with acid. At least partly for reasons of economy, orthophosphoric acid is generally preferred for use in this invention.

Aqueous solutions of any sufficiently water soluble salts of these phosphoric acid(s) can be used as component (B) in an aqueous liquid composition according to this invention, but, as already briefly noted above, it is preferable to utilize aqueous liquid compositions prepared by dissolving metal oxide(s) and/or hydroxide(s), hereinafter often jointly abbreviated as "(hydr)oxide(s)", in aqueous phosphoric acid solutions rather than solutions of the salts themselves. The preferred treatment solutions are described in this way because it is often possible to obtain transparent and otherwise apparently stable solutions by dissolving metal (hydr) oxide(s) in aqueous solutions of phosphoric acid, even though these apparent solutions are "supersaturated" with respect to the phosphate and/or mono- or di-acid phosphate salt or salts to which their phosphoric acid and metal contents nominally correspond. Although the invention is not to be considered to be limited by any theory, it is believed that these "supersaturated" solutions may contain coordination compounds or other chemical species of unknown structure that are at least part of the reason for their hydrophilicizing properties. Furthermore, it is preferable to dissolve the phosphoric acid(s), followed by the metal (hydr)oxide(s), before addition of any other ingredients except water, in preparing an aqueous liquid composition according to this invention. An aqueous solution formed in this way may then be added to a separately prepared solution containing some or all of the other ingredients to be included in a composition according to the invention, or these ingredients may be added directly to the solution formed by dissolving metal (hydr)oxide(s)in aqueous phosphoric acid.

Preferably the metal (hydr)oxide(s) codissolved with phosphoric acid in an aqueous liquid composition used according to the invention are (hydr)oxide(s) of metals with a valence of at least two, more preferably exactly two. The single most preferred metal is magnesium. When (hydr) oxide(s) of one or more divalent metals are used with orthophosphoric acid as preferred to form component (B) in situ in the course of preparing an aqueous liquid composition according to the invention, the molar ratio of the divalent metal to the phosphorus atoms in the orthophosphoric acid preferably is at least, with increasing preference in the order given, 1.0:5.0, 1.0:4.0, 1.0:3.5, 1.0:3.0, 1.0:2.8, 1.0:2.6, 1.0:2.4, 1.0:2.3, 1.0:2.2, 1.0:2.1, or 1.0:2.05 and independently preferably is not more than 1.0:0.5, 1.0:0.8, 1.0:1.0, 1.0:1.2, 1.0:1.4, 1.0:1.6, 1.0:1.7, 1.0:1.8, 1.0:1.9, or 1.0:1.95. The center of the most preferred range thus corresponds to the metal dihydrogen phosphate salt of the divalent metal.

Independently, at the time of mixing of metal (hydr)oxide (s) with aqueous phosphoric acid in the course of making an aqueous liquid composition according to the invention, the initial concentration of the phosphoric acid(s), measured as the sum of the stoichiometric equivalents as orthophosphoric acid of all phosphoric acid(s) present in which phosphorus is in its +5 valence state, preferably is at least, with increasing preference in the order given, 0.007, 0.011, 0.020, 0.030, 0.040, 0.050, 0.058, 0.064, 0.068, or 0.072 moles of orthophosphoric acid per kilogram of total aqueous liquid composition, this concentration unit, which may be applied to any ingredient of the composition that has a defined mole, being hereinafter usually abbreviated as "M/kg", and independently this concentration value in an aqueous liquid composition according to the invention preferably is not more than, with increasing preference in the order given, 1.5, 1.0, 0.8, 0.6, 0.4, 0.200, 0.160, 0.130, 0.100, 0.090, 0.080, or 0.074 M/kg.

In the course of preparing an aqueous liquid composition according to the invention, if component (B) is used and is prepared in situ as described above, component (A) is preferably added to an aqueous solution containing component (B) before addition of any other ingredients of the composition, except for water.

A working composition according to this invention preferably has a pH value that is at least, with increasing preference in the order given, 3.0, 3.5, 4.0, 4.3, 4.6, 4.9, 5.2, or 5.4 and independently preferably is not more than, with increasing preference in the order given, 9.0, 8.5, 8.0, 7.5, 7.0, 6.5, 6.2, 6.0, 5.8, or 5.6. If a preferred pH value is not achieved by the amounts of components (A) and (B) used in a composition according to the invention, an alkalinizing or acidifying agent, optional component (C), preferably should be added to the composition. A wide variety of suitable agents for this purpose are known to those skilled in the art. If an alkalinizing agent is needed, as is usual when components (A) and (B) have their most preferred chemical characteristics and concentrations, the same chemical type(s) of metal (hydr)oxide(s) as were used to form component (B) in situ in the course of preparation of the composition are preferably used as alkalinizing agents. Any amount of metal (hydr)oxide(s) used for this purpose are not considered part of the metal (hydr)oxide(e) reacted in situ to generate component (B) as described above, for the purpose of determining compliance with any of the preferred molar ratio limits specified above for this in situ reaction.

It has been observed that compositions according to the invention that contain only components (A) through (C) in addition to water are susceptible to the development of fungal infestations from apparently ambient air-borne fungi. Therefore at least a fungicide is normally preferably present in a composition according to the invention as optional component (D). A particularly suitable fungicide is 2-(4-thiazolyl)benzimidazole, which has the special advantage of successful long term use as a medicine for humans and thus is very unlikely to have any unexpected toxicity.

A working composition according to the invention preferably contains, independently for each component specified: component (A) in a concentration that is at least 1.0, 2.0, 3.0, 4.0, 5.0, 6.0, 7.0, 8.0, 8.5, 9.0, 9.5, or 9.9 parts of component (A) per thousand parts of the total composition by weight, a concentration unit which may apply generally to any other specified material as well as to component (A) and hereinafter is usually abbreviated as "ppt", and independently preferably is not more than, with increasing preference in the order given, 100, 75, 50, 30, 25, 22, 19, 16, 14, 13.0, 12.5, 12.0, 11.5, 11.0, 10.5, or 10.1 ppt; component (B) in a concentration that is at least, with increasing preference in the order given, 0.5, 1.0, 1.3, 1.6, 1.9, 2.1, 2.3, 2.5, or 2.7 ppt and independently preferably is not more than, with increasing preference in the order given, 25, 15, 10, 9.0, 8.0, 7.0, 6.0, 5.0, 4.5, 4.0, 3.5, 3.3, 3.1, or 2.9 ppt; and component (D) in a concentration that is at least, with increasing preference in the order given, 0.1, 0.3, 0.5, 0.7, or 0.9 ppt and independently preferably is not more than, with increasing preference in the order given, 5, 3, 2.5, 2.0, 1.8, 1.6, 1.4, 1.2, or 1.0 ppt. All of the preferred upper limits in the preceding parts of this paragraph are preferred primarily for economy—larger concentrations do not improve the results achieved and are more costly. The lower limits are preferred in order to get a strongly hydrophilic surface. The amount of component (C) preferably should be chosen so as to achieve the preferred pH values for the composition that have already been specified above.

For various reasons it is often preferred that compositions according to the invention as defined above should be substantially free from many ingredients used in compositions for similar purposes in the prior art. Specifically, it may be increasingly preferred in the order given, independently for each preferably minimized component noted below, that these compositions, when directly contacted with metal in a process according to this invention, contain no more than 1.0, 0.35, 0.10, 0.08, 0.04, 0.02, 0.01, or 0.001% of each of the following constituents, except to whatever extent such constituents may be part of necessary or optional components of the compositions as specified above: any metallic element with an atomic number higher than 20, except for titanium, zirconium, and hafnium in complex fluoride anions; nitrate and other oxidizing agents (any others being measured as their oxidizing stoichiometric equivalent as nitrate); organic liquids with a boiling point below 120° C. at normal atmospheric pressure; and dispersed silica and/or alumina.

After contact is established between the aqueous liquid treatment composition and the surface to be hydrophilicized, the treated surface is dried, preferably without any intermediate rinsing. The surface may be dried simply by exposure to ambient air with a relative humidity of less than 100%, but ordinarily it is preferable to utilize hot air, which may promote some advantageous chemical reaction in the coating as well as definitely speeding the drying process. The temperature at which the coating applied according to this invention is dried preferably is at least, with increasing preference in the order given, 100, 125, 135, 138, 142, 145, or 148° C. and independently preferably is not more than, with increasing preference in the order given, 200, 175, 165, 162, 159, 156, 153, or 150° C. The amount of carbon, derived at least partly from component (A) in a composition according to the invention and measured as grams of carbon per square meter of surface treated (a unit which may be applied to other materials than carbon and is hereinafter usually abbreviated as "g/m$^2$"), that is added-on to the surface after drying during treatment with a composition according to this invention as described above, a value that can readily be determined from surface emission analysis, preferably corresponds to at least, with increasing preference in the order given, 0.05, 0.10, 0.14, 0.18, 0.21, 0.24, or 0.26 g/m$^2$ and independently, primarily for reasons of economy, preferably is not more than, with increasing preference in the order given, 2.0, 1.5, 1.10, 0.80, 0.50, 0.40, 0.32, or 0.28 g/m$^2$. Of course, if the primary treatment applied before treatment with a composition according to this invention also contains carbon, as do the most preferred primary treatments, the carbon emission from the surface treated must be measured both before and after treatment according to this invention in order to determine, by difference between the two values, the add-on amount attributable to treatment with a composition according to this invention.

A hydrophilicizing treatment according to the invention may be applied over any type of surface that is not already completely hydrophilic. A hydrophilicizing treatment according to this invention is generally advantageous when applied over underlying metals that already have conversion coatings according to the teachings of any one of the following U.S. Patents, the disclosures of all of which, except for any part that may be inconsistent with any explicit statement herein, are hereby incorporated herein by reference: U.S. Pat. No. 5,595,611 of Jan. 21, 1997 to Boulos et al.; U.S. Pat. No. 5,551,994 of Sep. 3, 1996 to Schriever; U.S. Pat. No. 5,534,082 of Jul. 9, 1996 to Dollman et al.; U.S. Pat. No. 5,507,084 of Apr. 16, 1996 to Ogino et al.; U.S. Pat. No. 5,498,759 of Mar. 12, 1996 to Nakada et al.; U.S. Pat. No. 5,498,300 of Mar. 12, 1996 to Aoki et al.; U.S. Pat. No. 5,487,949 of Jan. 30, 1996 to Schriever, U.S. Pat. No. 5,472,524 of Dec. 5, 1995; U.S. Pat. No. 5,472,522 of Dec. 5, 1995 to Kawaguchi et al; U.S. Pat. No. 5,452,884 of Oct. 3, 1995; U.S. Pat. No. 5,451,271 of Sep. 19, 1995 to Yoshida et al.; U.S. Pat. No. 5,449,415 of Sep. 19, 1995 to Dolan; U.S. Pat. No. 5,449,414 of Sep. 12, 1995 to Dolan; U.S. Pat. No. 5,427,632 of Jun. 27, 1995 to Dolan; U.S. Pat. No. 5,415,687 of May 16, 1995 to Schriever; U.S. Pat. No. 5,411,606 of May 2, 1995 to Schriever; U.S. Pat. No. 5,399,209 of Mar. 21, 1995 to Suda et al.; U.S. Pat. No. 5,395,655 of Mar. 7, 1995 to Kazuyuki et al.; U.S. Pat. No. 5,391,239 of Feb. 21, 1995 to Boulos; U.S. Pat. No. 5,378,392 of Jan. 3, 1995 to Miller et al.; U.S. Pat. No. 5,366,567 of Nov. 22, 1994 to Ogino et al.; U.S. Pat. No. 5,356,490 of Oct. 18, 1994 to Dolan et al.; U.S. Pat. No. 5,342,556 of Aug. 30, 1994 to Dolan; U.S. Pat. No. 5,318,640 of Jun. 7, 1994 to Ishii et al.; U.S. Pat. No. 5,298,092 of Mar. 29, 1994 to Schriever; U.S. Pat. No. 5,281,282 of Jan 25, 1994 to Dolan et al.; U.S. Pat. No. 5,268,042 of Dec. 7, 1993 to Carlson; U.S. Pat. No. 5,261,973 of Nov. 16, 1993 to Sienkowski et al.; U.S. Pat. No. 5,242,714 of Sep. 7, 1993 to Steele et al.; U.S. Pat. No. 5,143,562 of Sep. 1, 1992 to Boulos; U.S. Pat. No. 5,141,575 of Aug. 25, 1992 to Yoshitake et al.; U.S. Pat. No. 5,125,989 of Jun. 30, 1992 to Hallman; U.S. Pat. No. 5,091,023 of Feb. 25, 1992 to Saeki et al.; U.S. Pat. No. 5,089,064 of Feb. 18, 1992 to Reghi; U.S. Pat. No. 5,082,511 of Jun. 21, 1992 to Farina et al.; U.S. Pat. No. 5,073,196 of Dec. 17, 1991; U.S. Pat. No. 5,045,130 of Sep. 3, 1991 to Gosset et al.; U.S. Pat. No. 5,000,799 of Mar. 19, 1991 to Miyawaki; U.S. Pat. No. 4,992,196 of Feb. 13, 1991 to Hallman; U.S. Pat. No. 4,985,087 of Jan. 15, 1992 to Mori et al.; U.S. Pat. No. 4,966,634 of Oct. 30, 1990 to Saeki et al.; U.S. Pat. No. 4,961,794 of Oct. 9, 1990 to Miyamoto et al.; U.S. Pat. No. 4,956,027 of Sep. 11, 1990 to Saeki et al.; U.S. Pat. No. 4,927,472 of May 22, 1990 to Matsushima et al.; U.S. Pat. No. 4,880,476 of Nov. 14, 1989 to Matsuda et al.; U.S. Pat. No. 4,874,480 of Oct. 17, 1989 to Sonoda et al.; U.S. Pat. No. 4,865,653 of Sep. 12, 1989 to Kramer; U.S. Pat. No. 4,849,031 of Jul. 18, 1989 to Hauffe et al.; U.S. Pat. No. 4,846,897 of Jul. 11, 1989 to Nakagawa et al.; U.S. Pat. No. 4,812,175 of Mar. 14, 1989 to Reghi; U.S. Pat. No. 4,801,337 of Jan. 31, 1989 to Higgins; U.S. Pat. No. 4,756,805 of Jul. 12, 1988 to Terada et al.; U.S. Pat. No. 4,749,418 of Jun. 7, 1988 to Saeki et al.; U.S. Pat. No. 4,722,753 of Feb. 2, 1988 to Zurilla et al.; U.S. Pat. No. 4,717,431 of Jan. 5, 1988 to Knaster et al.; U.S. Pat. No. 4,673,444 of Jun. 16, 1987 to Saito et al.; U.S. Pat. No. 4,668,305 of May 26, 1987 to Dotlman et al.; U.S. Pat. No. 4,650,525 of Mar. 17, 1987 to Yoshida et al.; U.S. Pat. No. 4,617,346 of Mar. 3, 1987 to Prescott; U.S. Pat. No. 4,644,029 of Feb. 17, 1987 to Cable et al.; U.S. Pat. No. 4,643,778 of Feb. 17, 1987 to Donofrio et al.; U.S. Pat. No. 4,637,840 of Jan. 20, 1987 to Fujii et al.; U.S. Pat. No. 4,637,838 of Jan. 20, 1987 to Rausch et al.; U.S. Pat. No. 4,617,068 of Oct. 14, 1986 to King; U.S. Pat. No. 4,596,607 of Jun. 24, 1986 to Huff et al.; U.S. Pat. No. 4,595,424 of Jun. 17, 1986 to Hacias; U.S. Pat. No. 4,565,585 of Jun. 21, 1986 to Matsuda; U.S. Pat. No. 4,559,087 of Dec. 17, 1985 to Jöms et al; U.S. Pat. No. 4,509,992 of Apr. 9, 1985 to Higgins; U.S. Pat. No. 4,498,935 of Feb. 12, 1985 to Kent et al.; U.S. Pat. No. 4,496,404 of Jan. 29, 1985 to King; U.S. Pat. No. 4,486,241 of Dec. 4, 1984 to Donofrio; U.S. Pat. No. 4,475,957 of Oct. 9, 1984 to Sander; U.S. Pat. No. 4,433,015 of Feb. 21, 1984 to Lindert; U.S. Pat. No. 4,419,199 of Dec. 6, 1983 to Hauffe et al.; U.S. Pat. No. 4,419,147 of Dec. 6, 1983 to Murakami et al.; U.S. Pat. No. 4,416,705 of Nov. 22, 1983 to Siemund et al.; U.S. Pat. No. 4,389,260 of Jun. 21, 1983 to Hauffe et al.; U.S. Pat. No. 4,385,096 of May 24, 1983 to Wetzel; U.S. Pat. No. 4,281,203 of Apr. 26, 1983 to Reinhold; U.S. Pat. No. 4,370,177 of Jan. 25, 1983 to Frelin et al.; U.S. Pat. No. 4,341,558 of Jul. 27, 1982 to Yashiro et al.; U.S. Pat. No. 4,339,310 of Jul. 13, 1982 to Oda et al.; U.S. Pat. No. 4,338,141 of Jul. 6, 1982 to Senzaki et al.; U.S. Pat. No. 4,338,140 of Jul. 6, 1982 to Reghi; U.S. Pat. No. 4,316,751 of Feb. 23, 1982 to Prescott et al.; U.S. Pat. No. 4,313,769 of Feb. 2, 1982 to Frelin et al.; U.S. Pat. No. 4,311,535 of Jan. 19, 1982 to Yasuhara et al.; U.S. Pat. No. 4,306,917 of Dec. 22, 1981 to Oda et al.; U.S. Pat. No. 4,295,899 of Oct. 20, 1981 to Oppen; U.S. Pat. No. 4,292,096 of Sep. 29, 1981 to Murakami et al.; U.S. Pat. No. 4,287,004 of Sep. 1, 1981 to Murakami et al.; U.S. Pat. No. 4,278,477 of Jul. 14, 1981 to Reinhold; U.S. Pat. No. 4,273,592 of Jun. 16, 1981 to Kelly; U.S. Pat. No. 4,264,378 of Apr. 28, 1981 to Oppen et al.; U.S. Pat. No. 4,220,486 of Sep. 2, 1980 to Matsushima et al.; U.S. Pat. No. 4,191,596 of Mar. 4, 1980 to Doliman et al.; U.S. Pat. No. 4,183,772 of Jun. 15, 1980 to Davis; U.S. Pat. No. 4,174,980 of Nov. 20, 1979 to Howell, Jr. et al.; U.S. Pat. No. 4,169,741 of Oct. 2, 1979 to Lampatzer et al.; U.S. Pat. No. 4,163,679 of Aug. 7, 1979 to Nagae et al.; U.S. Pat. No. 4,153,479 of May 8, 1979 to Ayano et al.; U.S. Pat. No. 4,149,909 of Apr. 17, 1979 to Hamilton; U.S. Pat. No. 4,148,670 of Apr. 10, 1979 to Kelly; U.S. Pat. No. 4,146,410 of Mar. 27, 1979 to Reinhold; U.S. Pat. No. 4,142,917 of Mar. 6, 1979 to Yashiro et al.; U.S. Pat. No. 4,136,073 of Jan. 25, 1979 to Mori et al.; U.S. Pat. No. 4,131,489 of Dec. 26, 1978 to Newhard, Jr.; U.S. Pat. No. 4,108,690 of Aug. 22, 1978 to Heller; U.S. Pat. No. 4,101,339 of Jul. 18, 1978 to Kaneko et al.; U.S. Pat. No. 4,063,968 of Dec. 20, 1977 to Matsushima et al.; U.S. Pat. No. 4,059,452 of Nov. 22, 1977 to Nishijima et al.; U.S. Pat. No. 4,054,466 of Oct. 18, 1977 to King et al.; U.S. Pat.

No. 4,017,334 of Apr. 12, 1977 to Matsushima et al.; U.S. Pat. No. 3,989,550 of Nov. 2, 1976 to Newhard; U.S. Pat. No. 3,964,936 of Jun. 22, 1976 to Das; U.S. Pat. No. 3,912,458 of Oct. 4, 1975 to Faigen; U.S. Pat. No. 3,879,237 of Apr. 22, 1975 to Faigen; U.S. Pat. No. 3,876,435 of Apr. 8, 1975 to Doliman; U.S. Pat. No. 3,860,455 of Jan. 14, 1975 to Hansen et al.; U.S. Pat. No. 3,850,700 of Nov. 26, 1974 to Heller; U.S. Pat. No. 3,839,099 of Oct. 1, 1974 to Jones; U.S. Pat. No. 3,819,424 of Jun. 25, 1974 to Russell et al.; U.S. Pat. No. 3,819,422 of Jun. 25, 1974 to Schneider; U.S. Pat. No. 3,819,385 of Jun. 25, 1974 to Schumichen et al.; U.S. Pat. No. 3,759,549 of Mar. 6, 1974 to Matsushima et al.; U.S. Pat. No. 3,758,349 of Sep. 11, 1973 to Engesser; U.S. Pat. No. 3,723,334 of Mar. 27, 1973 to Maurer; U.S. Pat. No. 3,723,192 of Mar. 27, 1973 to Obi et al.; U.S. Pat. No. 3,706,604 of Dec. 19, 1972 to Paxton; U.S. Pat. No. 3,697,332 of Oct. 10, 1972 to Kuehner; U.S. Pat. No. 3,671,332 of Jun. 20, 1972 to Rausch et al.; U.S. Pat. No. 3,660,172 of May 2, 1972 to Otto; U.S. Pat. No. 3,645,797 of Feb. 29, 1972 to Lorin; U.S. Pat. No. 3,632,447 of Jan. 4, 1972 to Albrecht et al.; U.S. Pat. No. 3,625,777 of Dec. 7, 1971 to Okabe et al.; U.S. Pat. No. 3,620,777 of Nov. 16, 1971 to Okabe et al.; U.S. Pat. No. 3,619,300 of Nov. 9, 1971 to Heller et al.; U.S. Pat. No. 3,615,912 of Oct. 26, 1971 to Dittel et at; U.S. Pat. No. 3,615,890 of Oct. 26, 1971 to Montetla; U.S. Pat. No. 3,607,453 of Sep. 21, 1971 to Engesser et at; U.S. Pat. No. 3,573,997 of Apr. 6, 1971 to Paxton; U.S. Pat. No. 3,565,699 of Feb. 23, 1971 to Paxton; U.S. Pat. No. 3,547,711 of Dec. 15, 1970 to Ashdown; U.S. Pat. No. 3,544,388 of Dec. 1, 1970 to Russell; U.S. Pat. No. 3,535,168 of Oct. 20, 1970 to Thompson; U.S. Pat. No. 3,533,859 of Oct. 13, 1970 to Engesser et al.; U.S. Pat. No. 3,519,494 of Jul. 7, 1970 to Engesser et al.; U.S. Pat. No. 3,516,875 of Jun. 23, 1970 to Rausch et at; U.S. Pat. No. 3,515,600 of Jun. 2, 1970 to Jones et al.; U.S. Pat. No. 3,505,129 of Apr. 7, 1970 to Burstein et al.; U.S. Pat. No. 3,501,352 of Mar. 17, 1970 to Shah; U.S. Pat. No. 3,493,441 of Feb. 3, 1970 to Rausch et al.; U.S. Pat. No. 3,493,440 of Feb. 3, 1970 to Ashdown; U.S. Pat. No. 3,484,304 of Dec. 16, 1969 to Beach; U.S. Pat. No. 3,468,724 of Sep. 23, 1969 to Reinhold; U.S. Pat. No. 3,467,589 of Sep. 16, 1969 to Rausch et al.; U.S. Pat. No. 3,462,319 of Aug. 19, 1969 to Campbell; U.S. Pat. No. 3,459,604 of Aug. 5, 1969 to Freeman et al.; U.S. Pat. No. 3,454,483 of Jul. 8, 1969 to Freeman; U.S. Pat. No. 3,450,578 of Jun. 17, 1969 to Siemund et at.; U.S. Pat. No. 3,450,577 of Jun. 17, 1969 to Beach; U.S. Pat. Nos. 3,449,229 and 3,449,222 of Jun. 10, 1969 to Freeman et al.; U.S. Pat. No. 3,444,007 of May 13, 1969 to Maurer et al.; U.S. Pat. No. 3,425,947 of Feb. 4, 1969 to Rausch et al.; U.S. Pat. No. 3,404,046 and U.S. Pat. No. 3,404,044 of Oct. 1, 1968 to Russell et al.; U.S. Pat. No. 3,404,043 of Oct. 1, 1968 to Dell; U.S. Pat. No. 3,397,093 of Aug. 13, 1968 to Oswald et al.; U.S. Pat. No. 3,397,092 of Aug. 13, 1968 to Cavanagh; U.S. Pat. No. 3,397,091 and U.S. Pat. No. 3,397,090 of Aug. 13, 1968 to Russell et at; U.S. Pat. No. 3,385,738 of May 28, 1968 to Russell; U.S. Pat. No. 3,380,858 of Apr. 30, 1968 to Champaneria et al.; U.S. Pat. No. 3,377,212 of Apr. 9, 1968 to Newhard; U.S. Pat. No. 3,347,713 of Oct. 17, 1967 to Lodeseen et al.; U.S. Pat. No. 3,338,755 of Aug. 29, 1967 to Jenkins et al.; U.S. Pat. No. 3,307,980 of Mar. 7, 1967 to Freeman; U.S. Pat. No. 3,297,493 of Jan. 10, 1967 to Blum et al.; U.S. Pat. No. 3,294,593 of Dec. 27,1966 to Wyszomirski et al.; U.S. Pat. No. 3,268,367 of Aug. 23, 1966 to Nelson; U.S. Pat. No. 3,240,633 of Mar. 18, 1966 to Gowman et al.; U.S. Pat. No. 3,222,226 of Dec. 7, 1965 to Maurer et al.; U.S. Pat. No. 3,218,200 of Nov. 16, 1965 to Henricks; U.S. Pat. No. 3,210,219 of Oct. 5, 1965 to Jenkins; U.S. Pat. No. 3,202,551 of Aug. 24, 1965 to Gerischer et al.; U.S. Pat. No. 3,197,344 of Jul. 27, 1965 to Paxton; U.S. Pat. No. 3,185,596 of May 25, 1965 to Schiffman; U.S. Pat. No. 3,161,549 of Dec. 15, 1964 to Kallenbach; U.S. Pat. No. 3,154,438 of Oct. 27, 1964 to Keller et al.; U.S. Pat. No. 3,146,113 of Aug. 25, 1964 to Lantoin; U.S. Pat. Nos. 3,130,086 and 3,130,085 of Apr. 21, 1964 to Otto; U.S. Pat. No. 3,101,286 of Aug. 20, 1963 to Reinhold; U.S. Pat. No. 3,090,710 of May 21, 1963 to Triggle et al.; U.S. Pat. No. 3,046,165 of Jul. 24, 1962 to Halversen et al.; U.S. Pat. No. 3,041,215 of Jun. 26, 1962 to Jenkins et al., U.S. Pat. No. 3,007,817 of Nov. 7, 1961 to Cavanagh et al.; U.S. Pat. No. 2,988,465 of Jun. 13, 1961 to Newhard et al.; U.S. Pat. No. 2,979,430 of Apr. 11, 1961 to Keller et al.; U.S. Pat. No. U.S. Pat. No. 2,967,791 of Jan. 10, 1961 to Halversen; U.S. Pat. No. 2,955,061 of Oct. 4, 1960 to Jenkins et al.; U.S. Pat. No. 2,928,763 of Mar. 15, 1960 to Russell et al.; U.S. Pat. No. 2,902,390 of Sep. 1, 1959 to Bell; U.S. Pat. No. 2,892,884 of Jun. 23, 1959 to Rausch et al.; U.S. Pat. No. 2,882,189 of Apr. 14, 1959 to Russell et al; U.S. Pat. No. 2,868,682 of Jan. 13, 1959 to Dell; U.S. Pat. No. 2,851,385 of Sep. 9, 1958 to Spruance et al.; U.S. Pat. No. 2,840,498 of Jun. 24, 1958 to Logue et al.; U.S. Pat. No. 2,835,617 of May 20, 1958 to Maurer; U.S. Pat. No. 2,832,707 of Apr. 29, 1958 to Rossteutscher; U.S. Pat. No. 2,825,697 of Mar. 4, 1958 to Carroll et al.; U.S. Pat. No. 2,819,193 of Jan. 7, 1958 to Rausch; U.S. Pat. No. 2,813,814 of Nov. 19, 1957 to Goodspeed et al.; U.S. Pat. No. 2,813,813 of Nov. 19, 1957 to Ley et al.; U.S. Pat. No. 2,813,812 of Nov. 19, 1957 to Somers et al.; U.S. Pat. No. 2,809,138 of Oct. 8, 1957 to Wagner et al.; U.S. Pat. No. 2,805,969 of Sep. 10, 1957 to Goodspeed et al.; U.S. Pat. No. 2,800,421 of Jul. 23, 1957 to Goodspeed et al.; U.S. Pat. No. 2,798,829 of Jul. 9, 1957 to Newhard et al.; U.S. Pat. No. 2,796,370 of Jun. 18, 1957 to Ostrander et al.; U.S. Pat. No. 2,769,737 of Nov. 6, 1956 to Russell; U.S. Pat. No. 2,702,768 of Feb. 22, 1955 to Hyams; U.S. Pat. No. 2,692,840 of Oct. 26, 1954 to Bell; U.S. Pat. No. 2,665,231 of Jan. 5, 1954 to Amundsen et al.; U.S. Pat. No. 2,609,308 of Sep. 2, 1952 to Gibson; U.S. Pat. No. 2,591,479 of Apr. 1, 1952 to Ward; 2,438,887 of Mar. 30, 1948 to Spruance, Jr.; U.S. Pat. No. 2,298,280 of Oct. 13, 1942 to Clifford et al.; U.S. Pat. No. 2,210,850 of Aug. 6, 1940 to Curtin; U.S. Pat. No. 2,121,574 of Jun. 21, 1938 to Romig; U.S. Pat. No. 2,120,212 of Jun. 7, 1938 to Curtin; U.S. Pat. No. 1,911,537 of May 30, 1933 to Tanner; U.S. Pat. No. 1,895,968 of Jan. 31, 1933 to Curtin et al.; U.S. Pat. No. 1,651,694 of Dec. 6, 1927 to Green et al.; U.S. Pat. No. 1,525,904 of Feb. 10, 1925 to Allen; U.S. Pat. No. 1,291,352 of Jan. 14, 1919 to Allen; U.S. Pat. No. 1,287,605 of Dec. 17, 1918 to Allen; and U.S. Pat. No. 1,248,053 of Nov. 27, 1917 to Allen.

Hydrophilicizing treatment according to the invention is particularly advantageously applied over conversion coatings formed on aluminum by treatment with acidic aqueous liquid compositions containing at least one of the chemical species $HB_4$, $H_2SiF_6$, $H_2TiF_6$, $H_2ZrF_6$, and the salts of any of these acids. More preferably, the liquid compositions used to form a conversion coating over which a hydrophilicizing treatment according to this invention is applied include at least one of $H_2TiF_6$, $H_2ZrF_6$, and salts of both of these acids, most preferably $H_2ZrF_6$ and its salts. Still more preferably the liquid compositions used to form a conversion coating over which a hydrophilicizing treatment according to this invention is applied also include a polymer of polyhydroxyalkylaminomethylene-substituted poly(vinyl phenol) as described in detail in U.S. Pat. No. 5,068,299, the entire disclosure of which, except for any part that may be inconsistent with any explicit statement herein, is hereby incorporated herein by reference. Most preferred are polymers having the composition resulting from the process and materials described at column 11 lines 47–55 of U.S. Pat. No. 5,068,299. Independently of other preferences, compositions of this most preferred type for forming a conversion coating to be hydrophilicized according to this invention preferably contain a total amount of $HB_4$, $H_2SiF_6$, $H_2TiF_6$, and $H_2ZrF_6$, this total including the stoichiometric equivalent as the corresponding acid of any salts of these acids that may be present and being hereinafter briefly denoted as "total fluoacid", such that the ratio by weight of total fluoacid in the conversion coating forming composition to the content of polyhydroxyalkylaminomethylene-substituted poly(vinyl phenol) as described in detail in U.S. Pat. No. 5,068,299 in the same composition is at least, with increasing preference in the order given, 0.02:1.0, 0.05:1.0, 0.08:1.0, 0.11:1.0, 0.13:1.0, 0.15:1.0, 0.17:1.0, 0.19:1.0, or 0.21:1.0 and independently preferably is not more than, with increasing preference in the order given, 2.0:1.0, 1.5:1.0, 1.0:1.0, 0.80:1.0, 0.60:1.0, 0.50:1.0, 0.40:1.0, 0.35:1.0, 0.30:1.0, 0.27:1.0, or 0.24:1.0. Independently, in a process of treatment with such compositions according to the invention, the amount of carbon, from the polymer content of the treatment composition, that is added-on to the surface treated as part of its primary coating is at least, with increasing preference in the order given, 0.04, 0.08, 0.12, 0.18, 0.24, 0.28, 0.30, 0.32, 0.34, or 0.36 $g/m^2$ and independently preferably is not more than, with increasing preference in the order given, 4.0, 3.0, 2.0, 1.0, 0.80, 0.60, 0.55, 0.50, 0.45, or 0.40 $g/m^2$.

The second most preferred chemical type of conversion coatings to be hydrophilicized according to this invention are those described in detail in U.S. Pat. No. 5,356,490 of Oct. 18, 1994 to Dolan et al. and U.S. Pat. No. 5,427,632 of Jun. 27, 1995 to Dolan. The entire disclosures of both of these patents, except for any part that may be inconsistent with any explicit statement herein, are hereby incorporated herein by reference.

As is known to those skilled in the art, before forming any kind of conversion coating on aluminum, it is ordinarily preferred to clean and deoxidize the surface by one of the means known in the art.

The practice and benefits of the invention may be further appreciated by consideration of the following non-limiting working and comparison examples.

EXAMPLE AND COMPARISON EXAMPLE GROUP 1

The surfaces treated were those on sample sheets (panels) of one of Type 3003 aluminum alloy or clad panels of the type used for automotive air conditioner heat exchangers. The processing sequence for all examples included the following steps in succession in the order shown below:

1. Cleaning by immersion of the substrate surfaces for 2 minutes (hereinafter usually abbreviated as "min") in a 1.5% solution of RIDOLINE® 53 Concentrate[2], commercially available from the Henkel Surface Technologies Div. of Henkel Corp., Madison Heights, this supplier being hereinafter usually abbreviated as "HST", this solution being maintained during use at 60° C.;

[2]This cleaner is not recommended for cleaning before chromating primary protective coatings, because it does not etch surfaces cleaned with it sufficiently to remove all oxides from the surfaces, and thin and uneven chromate coatings usually result. However, it is fully satisfactory as a cleaner for the primary protective coatings actually used in this group of examples.

2. Rinse with cold tap water for 40 seconds (hereinafter usually abbreviated as "sec").
3. Primary protective coating treatment—see details for particular instances below.
4. Rinse with cold tap water for 40 sec.
5. Hydrophilicizing treatment—see composition details for particular instances below. The sample was immersed in the liquid composition at normal ambient atmospheric pressure and ambient temperature (i.e., 18–23° C.), and, after a few seconds, withdrawn from immersion with a coating of the liquid clinging to its surface. In many instances, no deliberate effort to thin this coating was made, while in other instances shaking, blowing with air, or the like was used to thin the coating to a desired extent, without drying it completely.
6. Heat the substrates, with the liquid coating from the end of step 5 still in place on them, at 149° C. for 20 min.

In this group, the primary protective coating treatment was provided by one of two methods as follows (the Roman numerals shown at left are used for identification in table(s) below):

I. Contact with an aqueous liquid composition consisting of the following ingredients in addition to water: (i) 2.0 ppt of a partially polyhydroxyalkylaminomethylene-substituted poly(4-vinyl phenol) of the chemical type produced as described in column 11 lines 47–56 of U.S. Pat. No. 5,068,299, (ii) 10.0 ppt of boric acid (i.e., $H_3BO_3$), and (iii) 0.43 ppt of fluorozirconic acid (i.e., $H_2ZrF_6$). This composition had a pH of 3.7 and was maintained at 43° C. while the aluminum panels were immersed in it for 90 sec.

II. Same as I, except that 0.24 ppt of fluorotitanic acid (i.e., $H_2TiF_6$) was substituted for all of the fluorozirconic acid used in alternative I.

The hydrophilicizing treatment compositions used were as follows (with the capital letters shown at left used for identification in table(s) below):

A. A solution in water of 0.5% of a chemical substance corresponding to the sodium salt of a polymer of 4-vinyl benzene sulfonic acid (actually made by sulfonating polystyrene), with a weight average molecular weight (as the sodium salt) of about 70,000.

B. A solution in water of 0.5% of the sodium salt of a polymer of vinyl sulfonic acid, with a weight average molecular weight (as the sodium salt) reported by a representative of its supplier (Aldrich Chemical Co.) to be about 4,000 to 6,000.

Details of the carbon add-on masses and some test results on finished panels are given in Table 1 below. Four replicate panels were used for each identifying number shown in Table 1, and results on each replicate were averaged to give the values reported in the Table. The water soak test for which results are shown consisted of immersing the coated substrates to be tested in a constant volume of deionized water through which fresh deionized water was kept constantly flowing at a rate suffcient to replace the entire constant volume of deionized water in which the tested substrates were immersed every 12 minutes.

EXAMPLE AND COMPARISON EXAMPLE GROUP 2

In this group, the surfaces treated were those on sample sheets (panels) of one of Types 3003, 5052, or 6061 aluminum alloys or on sample pieces of either serpentine or stacked fin-and-plate commercial evaporator structures of the type used for automotive

TABLE 1

| Identification Number | Protective Coating Code | Hydrophilicizing Treatment Code | mg/m² of Carbon on Treated Surface: Initially | mg/m² of Carbon on Treated Surface: After 100 Hours of Water Soak | Equilibrium Contact Angle on Surface, Degrees: Initially | Equilibrium Contact Angle on Surface, Degrees: After 100 Hours of Water Soak | Equilibrium Contact Angle on Surface, Degrees: After Exposure for 168 Hours to Air with 100% RH at 38° C. |
|---|---|---|---|---|---|---|---|
| 1.1 | None | None | 11 | 12 | 16 | 26 | 21 |
| 1.2 | I | None | 144 | 144 | <5 | <5 | 11 |
| 1.3 | I | A | 207 | 207 | <5 | 8 | 17 |
| 1.4 | I | B | 254 | 180 | <5 | <5 | 8 |
| 1.5 | II | None | 65 | 63 | 14 | 21 | 41 |
| 1.6 | II | A | 105 | 69 | 5 | 39 | 49 |
| 1.7 | II | B | 173 | 126 | 9 | 17 | 38 |

Abbreviation for Table 1
"RH" means "relative humidity"

air conditioner heat exchangers. (These structures have a spacing between plates, through channels in which refrigerant heat transfer fluid flows when an air conditioner incorporating such a structure is in use, of about one centimeter, and a spacing between fins, around which air flows when an air conditioner incorporating such a structure is in use, of about one millimeter.) The processing sequence for all examples included the following steps in succession in the order shown below:

1. Alkaline etch/clean by immersion of the samples in a solution of 5% by volume of PARCO® Cleaner 305 concentrate cleaner formulation, commercially available from HST, in water at 60° C. for 2.0 min.
2. Rinse twice with cold tap water for 20 sec each time.
3. Deoxidize by immersion in a 12% by volume solution of a 70% solution of $HNO_3$ in water for 2.5 min at 21° C.
4. Rinse twice with cold tap water for 20 sec each time.
5. Primary protective coating treatment—see details for particular instances below.
6. Rinse with cold tap water for 40 sec.
7. Hydrophilicizing treatment—see composition details for particular instances below. The sample was immersed in the liquid composition at normal ambient atmospheric pressure and ambient temperature (i.e., 18–23° C.), and, after at least a few seconds, withdrawn from immersion with a coating of the liquid clinging to its surface. In many instances, no deliberate effort to thin this coating was made, while in other instances shaking, blowing with air, or the like was used to thin the coating to a desired extent, without drying it completely.
8. Heat the substrates, with the liquid coating from the end of step 7 still in place on them, at 149° C. for 20 min.

The primary protective coating treatment for Group 2 was provided by method I as used in Group 1 or by one of the methods as follows (the Roman numerals shown at left are used for identification in table(s) below):

III. Chromate conversion coating by immersion in a 4% by weight solution in water of ALODINE® 713 Chromium Conversion Coating concentrate (from HST) at 38° C. for 180 sec to produce an add-on mass of about 1050 mg/m².

IV. Same as Method I for Group 1, except that no boric acid was used in the treatment liquid composition.

V. A solution was prepared and used as described in the examples of U.S. Pat. No. 5,356,490 of Oct. 18, 1994 to Dolan et al., but with the following amounts of materials: 27.9 ppt of 60% fluorotitanic acid; 1.4 ppt of silica; 4.9 ppt of zirconium basic carbonate; 68 ppt of the 10% polymer solution made according to the directions of column 11 lines 39–52 of U.S. Pat. No. 4,963,596; and the balance water.

VI. A solution containing 94 ppt of magnesium acetate tetrahydrate and 149 ppt of a cobalt nitrate solution in water containing 13% of cobalt, with the balance water, was used to treat the aluminum substrates by immersion for 4 min at 54° C.

The following hydrophilicizing treatment compositions were used (the capital letters shown being used for identification in the table(s) below):

C. Four (4.0) liters of an aqueous solution containing 1.0% of the sodium salt of polymers of 4vinyl benzene sulfonic acid and 0.10% of 2-(4-thiazolyl) benzimidazole (fungicide) was mixed with 300 grams of a separate aqueous solution previously formed by adding to water 121 ppt of 75% $H_3PO_4$ in water and subsequently 26.3 ppt of 95% $Mg(OH)_2$ for a total of 1000 parts of solution. The pH of the resulting mixture was then adjusted to 5.2 by adding to the mixture about 1.5 grams of 95% $Mg(OH)_2$.

D. PALENE® 4546 hydrophilicizing treatment concentrate, prepared as directed by the manufacturer, Nihon Parkerizing Co., Ltd. This treatment composition does not contain polymers with sulfonic acid or its salt moieties in the polymer and therefore is not according to this invention.

E. An aqueous solution formed by adding to water 121 ppt of 75% $H_3PO_4$ in water and 26.3 ppt of 95% $Mg(OH)_2$ for a total of 1000 parts of solution—not according to this invention.

F. Same as C, except that the additions of the solution containing a reaction product of phosphoric acid and magnesium hydroxide and of additional magnesium hydroxide were omitted.

G. A solution in water of 15 ppt of sodium ammonium decavanadate—not according to the invention.

H. A solution in water of: 39 ppt of lithium hydroxide monohydrate; 57 ppt of glacial acetic acid; 12 ppt of sodium ammonium decavanadate; 0.02 ppt of CHEMEEN™ C-12G surfactant; and the balance water.

Table 2 below gives additional details and hydrophilicity test (contact angle of water) results for examples on sample sheets. The water soak test for which results are reported was performed in the same manner as for Group 1.

Table 3 below gives corrosion test results on all five types of samples after 1008 hours exposure to air at 100% Relative Humidity and a temperature of 38° C. The rankings scale for the two rightmost columns of Table 3 was as follows: 1=no detectable discoloration; 2=some light discoloration; 3=light discoloration and some white corrosion products on the surface; 4=heavy discoloration and some white corrosion products on the surface.

Some of the samples were additionally evaluated for odor production by a panel trained and operating according to the methods of American Society for Testing and Materials Standard Test Procedures 758, 434, and 594. These ratings indicate that products prepared according to preferred embodiments of the invention had no more tendency, and may have had less tendency, compared with the currently commercial hydrophilicizing products with the best resistance to developing disagreeable odors, to develop odors objectionable to most raters.

TABLE 2

| Primary Treatment | Hydrophilicizing Treatment | Contact Angle in Degrees: Immediately after Treatment on Alloy: | | | After 100 Hours of Water Soaking on Alloy | | | % of Initial mg/m² of Carbon After Water Soak |
|---|---|---|---|---|---|---|---|---|
| Code | Code | 3003 | 5052 | 6061 | 3003 | 5052 | 6061 | |
| None | None | 30 | 36 | 17 | 26 | 24 | 13 | n.m. |
| III | None | 36 | 68 | 20 | 34 | 50 | 11 | n.m. |
| III | D | 14 | 14 | 14 | 43 | 43 | 39 | 23 |
| III | E | 9 | 9 | 9 | 6 | 6 | <5 | n.m. |
| I | None | 38 | 42 | 35 | 5 | 12 | 8 | 100 |
| IV | F | 6 | 8 | 10 | <5 | 5 | 5 | 90 |
| IV | C | 8 | 10 | 7 | <5 | <5 | <5 | 72 |
| IV | D | 13 | 13 | 10 | 40 | 38 | 41 | 62 |
| V | G | <5 | <5 | <5 | 6 | 5 | 5 | 94 |
| VI | G | 6 | 6 | 5 | 5 | 6 | <5 | n.m. |
| V | H | <5 | <5 | <5 | 7 | <5 | <5 | 88 |
| VI | H | 7 | 5 | 5 | 8 | <5 | <5 | n.m. |

Abbreviation for Table 2
"n.m." means "not meaningful, because there was < 0.015 g/m² of carbon even before soaking".

TABLE 3

| Primary Treatment | Hydrophilicizing Treatment | Percent of Surface Discolored on Sheets of Alloy: 3003 | 5052 | 6061 | Ranking for Non-Sheet Substrates: Serpentine | Stacked |
|---|---|---|---|---|---|---|
| None | None | 95 | 100 | 100, 15% W | 4 | 4 |
| III | None | 5 | 5 | 50 | 2 | 2 |
| III | D | 90, 5% W | 0 | 90, 3% W | 4 | 1 (Sws) |
| III | E | 2 | 0 | 3 | 2 | 1 |
| I | None | 5 | 2 | 5 | 3 | 3 |
| IV | F | 15 | 40 | 40 | 3 | 2 |
| IV | C | 3 | 0 | 1 | 2 | 1 |
| IV | D | 100 | 80 | 100 | 4 | 3 |
| V | G | 0 | 0 | 0 | 1 | 1 |
| VI | G | 0 | 0 | 0 | 1 | n.t. |
| V | H | 70 | 25 | 30 | 2 | 2 |
| VI | H | 80 | 10 | 70 | n.t. | n.t. |

Abbreviations for Table 3
"% W" means "percent of the surface had white corrosion products on it when observed"; "I (Sws)" means "one small white spot was observed on the surface, but otherwise there was no discoloration of the surface"; "n.t." means "not tested"

The invention claimed is:

1. A process for increasing the hydrophilicity of a solid surface on which pure liquid water has, under normal atmospheric pressure and a temperature within the range of 18–23° C. an initial contact angle that is at least 5 degrees, said process comprising steps of:

(I) forming over said solid surface a coating of a hydrophilicizing liquid composition comprising water and a concentration of a component (A) selected from the group consisting of dissolved, stably dispersed, or both dissolved and stably dispersed organic polymer molecules containing —$SO_3M$ moieties, where M represents hydrogen, a monovalent cation, or a monovalent fraction of a cation with a valence of two or higher, and of a component (B) of at least one dissolved substance made by dissolving a member selected from the group consisting of elemental divalent metals, divalent metal oxides, divalent metal hydroxides and mixtures thereof in aqueous phosphoric acid; and (II) drying the coating of the liquid composition formed in step (I) to form a modified solid surface on which at least part of the polymers containing —$SO_3M$ moieties that were in the coating of hydrophilicizing liquid composition formed in step (i) remain bound, pure liquid water under normal atmospheric pressure and temperature having an initial contact angle on said modified solid surface that is smaller than its contact angle on the solid surface coated in step (I).

2. A process according to claim 1, wherein the concentration of component (A) in the hydrophilicizing liquid composition is in a range from about 1.0 to about 100 ppt and the hydrophilicizing liquid composition additionally comprises a concentration that is from about 0.5 to about 25 ppt of a component (B) of one or more dissolved substances selected from the group consisting of substances that have been made by dissolving at least one of elemental divalent metals, divalent metal oxides, and divalent metal hydroxides in aqueous phosphoric acid.

3. A process according to claim 2, wherein the hydrophilicizing liquid composition has a pH value from about 4.0 to about 8.0.

4. A process according to claim 3, wherein the solid surface coated in step (I) has been formed by treating an aluminum substrate with an acidic aqueous liquid composition that comprises at least one chemical species selected from the group consisting of $HBF_4$, $H_2SiF_6$, $H_2TiF_6$, $H_2ZrF_6$, and the salts of any of these acids.

5. A process according to claim 4, wherein:

component (A) is selected from the group consisting of sulfonated polystyrene molecules in which there is a ratio of —$SO_3M$ moieties to aromatic rings that is at least 0.85:1.0;

the concentration of component (A) in the hydrophilicizing liquid composition is from about 8.0 to about 13.0 ppt;

the concentration of component (B) in the hydrophilicizing liquid composition is from about 2.1 to about 4.5 ppt;

the pH value of the hydrophilicizing liquid composition is from about 4.6 to about 6.2;

component (B) is selected from materials made by mixing (i) a number of kilograms of an aqueous solution of phosphoric acid having a concentration corresponding stoichiometrically to a concentration of from about 0.058 to about 0.100 M/kg of orthophosphoric acid with (ii) an amount of magnesium hydroxide, magnesium oxide, or both magnesium hydroxide and magnesium oxide that contains a number of moles of magnesium that has a ratio to a mathematic product of the number of kilograms of and the concentration in M/kg of said aqueous solution of phosphoric acid that is from 1.0:2.2 to about 1.0:1.8;

step (II) of the process occurs at a temperature in a range from about 135 to about 175° C.; and from about 0.14 to about 0.50 g/m$^2$ of carbon are added on to the solid surface treated in step (I) after completion of step (II).

6. A process for increasing the hydrophilicity of a solid surface on which pure liquid water has, under normal atmospheric pressure and a temperature within the range of 18–23° C., an initial contact angle that is at least 5 degrees, said process comprising at steps of:

(I) forming over said solid surface a coating of a hydrophilicizing liquid composition that has been made by mixing water and an amount of a component (A) selected from the group consisting of dissolved, stably dispersed, or both dissolved and stably dispersed organic polymer molecules containing —$SO_3M$ moieties, where M represents hydrogen, a monovalent cation, or a monovalent fraction of a cation with a valence of two or higher and of a component (B) comprised of at least one dissolved substance made by dissolving a member selected from the group consisting of elemental divalent metals, divalent metal oxides, divalent metal hydroxides and mixtures thereof in phosphoric acid; and (II) drying the coating of liquid composition formed in step (I) to form a modified solid surface on which at least part of the polymers containing —$SO_3M$ moieties that were in the coating of hydrophilicizing liquid composition formed in step (i) remain bound, pure liquid water under normal atmospheric pressure and temperature having an initial contact angle on said modified solid surface that is smaller than its contact angle on the solid surface coated in step (I).

7. A process according to claim 8, wherein the hydrophilicizing liquid composition is made by mixing water:

an amount of component (A) that corresponds to a concentration of from about 1.0 to about 100 ppt of component (A) in the hydrophilicizing liquid composition; and an amount of component (B) corresponding a concentration of from about 0.5 to about 25 ppt of component (B) in the hydrophilicizing liquid composition.

8. A process according to claim 7, wherein the hydrophilicizing liquid composition has a pH value from about 4.0 to about 8.0.

9. A process according to claim 8, wherein the solid surface coated in step (I) has been formed by treating an aluminum substrate with an acidic aqueous liquid composition that comprises at least one chemical species selected from the group consisting of $HBF_4$, $H_2SiF_6$, $H_2TiF_6$, $H_2ZrF_6$, and the salts of any of these acids.

10. A process according to claim 9, wherein:

component (A) is selected from the group consisting of sulfonated polystyrene molecules in which there is a ratio of —$SO_3M$ moieties to aromatic rings that is at least 0.85:1.0;

the amount of component (A) mixed with water to form the hydrophilicizing liquid composition corresponds to a concentration of component (A) in the hydrophilicizing liquid composition that is from about 8.0 to about 13.0 ppt;

the amount of component (B) mixed with water to form the hydrophilicizing liquid composition corresponds to a concentration of component (B) in the hydrophilicizing liquid composition that is from about 2.1 to about 4.5 ppt;

the pH value of the hydrophilicizing liquid composition is from about 4.6 to about 6.2;

component (B) is selected from materials made by mixing (i) a number of kilograms of an aqueous solution of phosphoric acid having a concentration corresponding stoichiometrically to a concentration of from about 0.058 to about 0.100 M/kg of orthophosphoric acid with (ii) an amount of magnesium hydroxide, magnesium oxide, or both magnesium hydroxide and magnesium oxide that contains a number of moles of magnesium that has a ratio to a mathematic product of the number of kilograms of and the concentration in M/kg of said aqueous solution of phosphoric acid that is from 1.0:2.2 to about 1.0:1.8;

step (II) of the process occurs at a temperature in a range from about 135 to about 175° C.; and from about 0.14 to about 0.50 g/m$^2$ of carbon are added on to the solid surface treated in step (I) after completion of step (II).

11. A liquid composition of matter suitable for treating a solid surface to increase the hydrophilicity thereof, said composition comprising water and:

(A) from about 1.0 to about 100 ppt of a component (A) selected from the group consisting of dissolved, stably dispersed, or both dissolved and stably dispersed organic polymer molecules containing —$SO_3M$ moieties, where M represents hydrogen, a monovalent cation, or a monovalent fraction of a cation with a valence of two or higher; and (B) from about 0.5 to about 25 ppt of a component (B) comprised of one or more dissolved substances selected from the group consisting of substances that have been made by dissolving in aqueous phosphoric acid at least one material selected from the group consisting of metals, metal oxides, and metal hydroxides wherein the metal comprises a divalent metal.

12. A composition according to claim 11, wherein the pH value is from about 4.0 to about 8.0.

13. A composition according to claim 12, additionally comprising a fungicide.

14. A composition according to claim 13, wherein:

component (A) is selected from the group consisting of (i) polymers of vinyl sulfonic acid and (ii) polymer molecules that have most, or more preferably all, of the —$SO_3M$ moieties directly chemically bonded to an aromatic ring;

the concentration of component (A) in the liquid composition is from about 4.0 to about 30 ppt;

the concentration of component (B) in the liquid composition is from about 1.3 to about 10 ppt, the pH value of the liquid composition is from about 4.0 to about 7.0.

15. A composition according to claim 14, wherein:

component (A) is selected from the group consisting of sulfonated polystyrene molecules in which there is a ratio of —$SO_3M$ moieties to aromatic rings that is at least 0.85:1.0;

the concentration of component (A) in the liquid composition is from about 8.0 to about 13.0 ppt;

the concentration of component (B) in the liquid composition is from about 2.1 to about 4.5 ppt;

the pH value of the liquid composition is from about 4.6 to about 6.2;

component (B) is selected from materials made by mixing (i) a number of kilograms of an aqueous solution of phosphoric acid having a concentration corresponding stoichiometrically to a concentration of from about 0.058 to about 0.100 M/kg of orthophosphoric acid with (ii) an amount of magnesium hydroxide, magnesium oxide, or both magnesium hydroxide and magnesium oxide that contains a number of moles of magnesium that has a ratio to a mathematic product of the number of kilograms of and the concentration in M/kg of said aqueous solution of phosphoric acid that is from 1.0:2.2 to about 1.0:1.8;

there is a concentration of from about 0.5 to about 1.6 ppt of 2-(4-thiazolyl)benzimidazole present as a fungicide.

16. A liquid composition of matter suitable for treating a solid surface to increase the hydrophilicity thereof, said composition having been made by mixing water and:

(A) an amount of a component (A) selected from the group consisting of dissolved, stably dispersed, or both dissolved and stably dispersed organic polymer molecules containing —$SO_3M$ moieties, where M represents hydrogen, a monovalent cation, or a monovalent fraction of a cation with a valence of two or higher; said amount of component (A) corresponding to a concentration of from about 1.0 to about 100 ppt of component (A) in said liquid composition; and (B) an amount of a component (B) of one or more water soluble substances selected from the group consisting of substances that have been made by dissolving in aqueous phosphoric acid at least one material selected from the group consisting of metals, metal oxides, and metal hydroxides, said amount of component (B) corresponding to a concentration of from about 0.5 to about 25 ppt of component (B) in said aqueous liquid composition.

17. A composition according to claim 16, wherein the liquid composition has a pH value from about 4.0 to about 8.0.

18. A composition according to claim 17, into which a fungicide has been mixed.

19. A composition according to claim 18, wherein:

component (A) is selected from the group consisting of (i) polymers of vinyl sulfonic acid and (ii) polymer molecules that have most, or more preferably all, of the —$SO_3M$ moieties directly chemically bonded to an aromatic ring;

the amount of component (A) corresponds to a concentration of component (A) in the liquid composition that is from about 4.0 to about 30 ppt;

the amount of component (B) corresponds to a concentration of component (B) in the liquid composition that is from about 1.3 to about 10 ppt;

the pH value of the liquid composition is from about 4.0 to about 7.0;

component (B) is selected from materials made by dissolving at least one material selected from the group consisting of oxides and hydroxides of metals in which the metal has a valence of at least two.

20. A composition according to claim 19, wherein:

component (A) is selected from the group consisting of sulfonated polystyrene molecules in which there is a ratio of —$SO_3M$ moieties to aromatic rings that is at least 0.85:1.0;

the amount of component (A) corresponds to a concentration of component (A) in the liquid composition that is from about 8.0 to about 13.0 ppt;

the amount of component (B) corresponds to a concentration of component (B) in the liquid composition that is from about 2.1 to about 4.5 ppt;

the pH value of the liquid composition is from about 4.6 to about 6.2;

component (B) is selected from materials made by mixing (i) a number of kilograms of an aqueous solution of phosphoric acid having a concentration corresponding stoichiometrically to a concentration of from about 0.058 to about 0.100 M/kg of orthophosphoric acid with (ii) an amount of magnesium hydroxide, magnesium oxide, or both magnesium hydroxide and magnesium oxide that contains a number of moles of magnesium that has a ratio to a mathematic product of the number of kilograms of and the concentration in M/kg of said aqueous solution of phosphoric acid that is from 1.0:2.2 to about 1.0:1.8;

an amount of 2-(4-thiazolyl)benzimidazole fungicide that corresponds to a concentration of from about 0.5 to about 1.6 ppt of this fungicide has been mixed into the liquid composition.

* * * * *

UNITED STATES PATENT AND TRADEMARK OFFICE

CERTIFICATE OF CORRECTION

PATENT NO. : 6,488,989 B1 
DATED : December 3, 2002
INVENTOR(S) : McCormick

It is certified that error appears in the above-identified patent and that said Letters Patent is hereby corrected as shown below:

Column 16,
Line 20, delete "18-23° C.", and insert therefor -- 18-23 °C., --.

Column 17,
Line 29, delete "18-23° C.,", and insert therefor -- 18-23 °C., --.
Line 30, after "comprising", delete "at".

Column 19,
Line 4, after "10 ppt", delete "," and insert therefor -- ; --.

Signed and Sealed this

Twelfth Day of August, 2003

JAMES E. ROGAN
*Director of the United States Patent and Trademark Office*